United States Patent [19]

Larkin et al.

[11] 4,032,441

[45] June 28, 1977

[54] METHOD FOR RECLAIMING USED HYDRAULIC FLUID

[76] Inventors: G. Eugene Larkin, 2598 W. 4900 S., Roy, Utah 84067; Richard H. Buchi, 849 E. 300 South, Bountiful, Utah 84010

[22] Filed: June 30, 1976

[21] Appl. No.: 701,280

[52] U.S. Cl. ..... 210/63 R; 208/177; 208/251 R; 210/73 R; 210/83

[51] Int. Cl.[2] ..... B01D 17/02

[58] Field of Search ..... 208/177, 187, 188, 251 R; 210/61, 63 R, 73 R, 73 W, 83, 167, 199, 202, 259

[56] References Cited

UNITED STATES PATENTS

| | | | |
|---|---|---|---|
| 3,341,449 | 9/1967 | Howard | 210/44 |
| 3,394,812 | 7/1968 | Cohen et al. | 210/167 X |
| 3,594,314 | 7/1971 | Bilhartz et al. | 210/83 X |

*Primary Examiner*—Frank A. Spear, Jr.
*Assistant Examiner*—R. G. Mukal
*Attorney, Agent, or Firm*—Joseph E. Rusz; William J. O'Brien

[57] ABSTRACT

A method for reclaiming used, petroleum base, aircraft operational hydraulic fluids by a method which includes the sequential steps of settling, aerating, foam inhibiting, adding of only supplemental amounts of additive agents and fine particle filtering.

1 Claim, No Drawings

METHOD FOR RECLAIMING USED HYDRAULIC FLUID

STATEMENT OF GOVERNMENT INTEREST

The invention described herein may be manufactured and used by or for the Government for governmental purposes without the payment of any royalty thereon.

BACKGROUND OF THE INVENTION

This invention relates to a method for reclaiming used hydraulic fluid. More particularly, this invention relates to a method for reconstituting contaminated, petroleum base hydraulic fluids to a form and quality that permits their re-use in applications which previously required the use of new hydraulic fluids.

The utilization of hydraulic fluids for various aerospace applications requires the use of fluids that meet stringent quality specifications. Generally, the servicing of aircraft landing gear and control systems with hydraulic fluids necessitates strict compliance with quality specifications. Consequently, the used fluids must be constantly replaced with new fluids resulting in increased operating costs. In an attempt to obviate this problem, considerable research has been conducted in an attempt to develop methods of reconstituting the used fluid for use in the same manner as a new fluid. The conventional prior art methods, however, employed either a distillation technique or a diatomaceous earth filtration technique. In either case, the technigue removed the various additive ingredients which formed an integral part of the hydraulic fluid. After reconstituation with these prior art methods, the expensive additive materials, such as oxidation inhibitors, corrosion inhibitors and antiwear agents, had to be completely replaced which tended to counteract any economic savings resulting from the use of a reconstituted product.

With the present invention, however, a method for reclaiming hydraulic fluids has been found that does not require the complete replacement of all additive materials, but allows for the mere supplementation of such additives. The filtration and reconstitution is accomplished without the use of distillation or diatomaceous earth filtration. The method involves a four step process which treats used hydraulic fluids containing particulate matter, water and freon gas contaminants. The process has proven to be especially effective in reclaiming used petroleum base, hydraulic fluids which meet the Military Specification requirements of MIL-H-5606C and MIL-H-6083 D, thereby rendering them reuseable for various aerospace applications such as aircraft landing gear and control systems.

SUMMARY OF THE INVENTION

According to the present invention, a used petroleum base hydraulic fluid, such as a H 5606 or H 6083 fluid can be easily and effectively reclaimed by a process in which the contaminants are removed without an accompanying removal of all additive materials present in the original fluid. In the process of the invention, the used contaminated fluid is placed in a suitable setting reservoir, then aerated, followed by the addition of an antifoaming agent and supplemental amounts of additive agents. The fluid is then treated for particulate removal of fine particles and is then ready for distribution to storage containers for future utilization in applications which called for the use of only new fluids.

Accordingly, the primary object of the invention is to provide a method for reclaiming used petroleum base, hydraulic fluids.

Another object of this invention is to provide a method for reclaiming used petroleum base, hydraulic fluids without resorting to distillation techniques or diatomaceous earth filtering techniques.

Still another object of this invention is to provide a method for reclaiming used petroleum base, hydraulic fluids that does not require the replacement of all additive agents originally present in new or unusued hydraulic fluids.

The above and still further objects and advantages of the present invention will become more readily apparent upon consideration of the following detailed description thereof.

DESCRIPTION OF THE PREFERRED EMBODIMENT

The present invention encompasses a process for reclaiming used petroleum base, hydraulic fuels by a method that removes solid and liquid contaminants without resorting to distillation or diatomaceous earth filtering. The unique process provides a facile, economical and efficient method for reconstituting used hydraulic fluids to a form and quality which permits their reuse in situations that formerly required the utilization of only new and unused hydraulic fluids. The invention is best illustrated by referring to the following description of the process.

In the process, a petroleum base, hydraulic fluid, such as hydraulic fluid MIL-H-6083 or MIL-H-5605 containing undesirable contaminants of water, Freon-TF, particulate matter and breakdown products is accommodated in a suitable storage container from the field location where it is collected. The incoming contaminated fluid is then processed in accordance with the following method steps:

1. Incoming contaminated fluid is placed in a settling reservoir to initially separate the heavy particulate foreign matter and most of the water from the liquid hydraulic fluid base. Optionally, the reservoir may be replaced by a mechanical filter or a large continuous flow reservoir. The function of the settling reservoir would be duplicated by either means.

2. After removel of the heavy particulate matter, the fluid is aerated by passing chemically dried air through the fluid. Aeration of the product has proven to be an important step owing to the use of "Freon TF" in cleaning hydraulic systems. The aeration step removes the "Freon TF" found in used fluid while also removing any water carried by the oil.

A dry air source is used since the "Freon" and water removal step is significantly enhanced through the use of dry air.

Conventionally, air is dried through the use of heat, however, in the present invention, room temperature, chemically dried air has been found most advantageous and also conserves the energy expended in the operation of the process.

3. Replacement of supplemental amounts of additive agents is accomplished at this point in the process, if required. Prior art process for recovery of petroleum products have employed distillation or diatomaceous earth filtration. Both of those means remove nearly all of the additives which remain in the used fluid and therefore require addition of completely new additives in the reconstituted product. Since the used oil normally shows little loss of additives, the removal and subsequent restoration of additives represents a significant coat factor in large-scale prior processes.

In the present invention, additives are only added to supplement those which have disappeared in the course of use of the fluids, particularly of note is the loss of the viscosity-improper additive. It has been found that only a very small quantity of supplemental additives is normally required.

At the same point in the process, an anti-foaming agent is added to the fluid. One long recognized problem in oil recovery is foaming of the reconstituted product. It has been discovered in the practice of the present invention that about 250 PPM (by weight) or less of Dow Corning -200 anti-foaming agent, when introduced subsequent to aeration, will cause the reconsistuted product to perform within the limitation of Mil Spec H-6083 or H-5606 for hydraulic fluid of two different characteristics. It should be noted that the figure of 250 PPM is only approximate and that the important factor is that the fluid meet the ASTM standard number D-892 for foaming.

4. In the last step, very fine particulate material is removed from the fluid, including any particles which were carried by the supplemental additives or anti-foaming agent. The first particulate removal can be accomplished by either electrostatic separation, centrifugal separation, membrane filtration, or mechanical filtration.

The means employed is determined by the combination of coat factors, quantity of fluid, and military specification limitations.

Upon passing through the fine particle removal step, the fluid is in condition for distribution by means of uncontaminated containers or by pipeline to potential use sources.

At this time, the recycled fluid is as acceptable as new fluid for aircraft control and landing gear applications or parts storage depending upon the type of fluid. It should be recognized, however, that certain minimal breakdown products are passed through the process and that over the course of several repetitions of reconstitution and reuse, the H-5605 fluid would become unacceptable for aircraft applications. The number of acceptable recycle operations followed by reuse is greater than ten for H-6083 which is used to store mechanical parts during repair and maintenance operations.

It also should be recognized that most hydraulic fluid begins as H-5606 in operational use and is then transferred to storage, with the addition of a corrosion inhibitor, as H-6083. Accordingly, when the breakdown products are removed and when the new additives are blended, the fluid in its reconstituted form is equivalent to new hydraulic fluid.

The reclaimed fluids of this invention were tested to evaluate their properties subsequent to treatment in accordance with the method of the invention. Two five-gallon cans of used 5606 Hydraulic Fluid and two five-gallon cans of used 6083 Hydraulic Fluid were tested in accordance with standard testing techniques. In Table I, which follows, test results show the properties of a new oil, as packaged, and a used oil of the same type. The used oil was then reconstituted in accordance with this invention, and the resulting test figures are shown on Table II for the reclaimed 5606 fluid, and in Table III for the reclaimed 6083 fluid.

TABLE I

| | (A) MM-H-5606 | | (B) MIL-H-6083 | |
|---|---|---|---|---|
| | New Oil as Packaged Brayco 756E | 1 Gal. Composite Of 2×5 Gal. Pails Used Oil | New Oil as Packaged Brayco 783E | 1 Gal. Composite of 2×5 gal. pails Used Oil |
| | TYPICALS | RESULTS | TYPICALS | RESULTS |
| Spec. Grav. at 60° F | 0.8702 | 0.8639 | 0.8740 | 0.9390 |
| API. Grav. at 60° F | 31.1 | 32.3 | 30.4 | 1.2 |
| Flask ° F | 215 | 235 | 220 | No Flask |
| Fire ° F | 230 | 240 | 235 | 315 |
| Vis. at 210° F cs | 5.08 | 4.72 | 4.74 | 359 |
| Vis. at 100° F cs | 14.4 | 13.92 | 14.3 | 9.39 |
| Vis. at −65° F, cs | 2200 | cloudy 2414 | 3200 | 1052 |
| V.I. | 346 | 324 | 284 | 347 |
| Water (KFR), PPM. | 70 | 1913 | 300 | 179 |
| TANE, ASTM D664 Curve | 0.00 | 0.084 | D974 0.168 | D974 0.056 |
| A.V. (Phenopath/Meth. O.) | 0.2A/0.23 | 0.4A/0.9B | 0.7A/0.4B | 0.2A/0.4B |
| QAS. Be, % | — | | 0.13 | 0.12 |
| Appearance | Br & Cl | Dark | Br & Cl | Cloudy |
| DISTILLATION | | | | |
| O. H. - % by volume | — | 2.5 | — | 12.1 |
| O. H. - Spec. Grav. | | 0.8368 | — | 1.543 |
| O. H. - Identity | — | Hydro Carbons | — | Freon Trace Hydrocarbons |
| BOTTOMS - ° API Grav at 60° F | | 32.1 | | 30.3 |
| BOTTOMS - VIS at 100° F. cs | | 14.85 | | 14.83 |

TABLE II

| TESTS | METHOD | SPECIFICATION REQUIREMENT | AML Rpt No MA769423 | | RESULTS |
|---|---|---|---|---|---|
| Gravity, ° API at 60° F | D 287 | — | | 31.1 | 31.8 |
| Specific at 60/60° F | Table 3 | — | | 0.8702 | 0.8665 |
| Pounds per gallon at 60° F | Table 8 | — | | 7.246 | 7.215 |
| Viscosity at 210° F, cs | D 445 | 5.0 | Min | 5.11 | 5.13 |
| Viscosity at 100° F, cs | | 14.0 | Min | 14.33 | 14.43 |
| Viscosity at −40° F, cs | | 500 | Max | 497 | 485 |
| Viscosity at −65° F, cs | | 3000 | Max | 2284 | 2168 |
| Pour Point, ° F | D 97 | −75.0 | Max | −90 | <−80 |

TABLE II-continued

| TESTS | METHOD | SPECIFICATION REQUIREMENT | | AML Rpt No MA769423 | | RESULTS |
|---|---|---|---|---|---|---|
| Flash Point, COC, ° F | D 92 | 200.0 | | Min | 220 | 240 |
| Acid or Base No., mg KOH/gm | D 664 | 0.20 | | Max | 0.086 | 0.056 |
| Color, Red, As Per Standard | Spec | | Pass | | Pass | Pass |
| Low Temp. Stab., 72 hrs. at −65° | 3459 | | Pass | | Pass | Pass |
| Evaporation, 4 hrs. at 150° F | 353 | | Pass | | Pass | Pass |
| Cu Strip Corr., 72 hrs. at 275° F | D 130 | 2e | | Max | 2b | 2a |
| Foaming Characteristics at 75° F | D 892 | | | | | |
| Tendency, ml (50" to BREAK) | | 65 | | Max | 40 | 55 |
| Stability, 10 min. Settling, ml | | 0 | | Max | 0 | 0 |
| Water by KFR, ppm | D 1744 | 100 | | Max | 100 | 77 |
| Steel-on-steel Wear, AWSD, mm | D 2266 | 1 | | Max | 0.65 | 0.86 |
| Workmanship | Spec | | Pass | | Pass | Pass |
| Corr.-Oxid. Stab., 168 hrs. at 275° F | 5308 | | | | | |
| Corrosion, pitting or etching | | | None | | None | None |
| Copper Corr., ASTM Std. No. | | 3 | | Max | 2d | 2b |
| Copper, Weight Change, mg/cm² | | 0.6 | | Max | −0.53 | −0.16 |
| Steel, Weight Change, mg/cm² | | 0.2 | | Max | −0.023 | −0.016 |
| Aluminum, Weight Change, mg/cm² | | 0.2 | | Max | −0.015 | −0.024 |
| Magnesium, Weight Change, mg/cm² | | 0.2 | | Max | 0.000 | −0.016 |
| Cadmium, Weight Change, mg/cm² | | 0.2 | | Max | +0.007 | −0.016 |
| Resistance to Oxidation | | | | | | |
| Change in Vis at 100° F, % | | −5 | to | +20 | +9.6 | −4.36 |
| Change in Acid or Base No. | | 0.20 | | Max | 0.02 | .056 |
| Separation or gumming of fluid | | | None | | None | None |
| Rubber Swell, L, 168 Hrs. at 158° F, % | 3603 | 19.0 | 30.0 | | 22.6 | 24.11 |
| Solid Particle Contamination | | | | | | |
| Gravimetric Method, mg/100 ml | Spec | 0.3 | Max | | | 0.05 |
| Solid Contaminant Particles/100 ml | 3009 | | | | | |
| 5 – 15, microns, particles | | 2500 | Max | | | 65 |
| 16 – 25, microns, particles | | 1000 | Max | | | 15 |
| 26 – 50, microns, particles | | 250 | Max | | | 10 |
| 51 – 100, microns, particles | | 25 | Max | | | 4 |
| Over 100 microns, particles | | 10 | Max | | | 3 |
| Filtering Time, minutes | | 15 | Max | | | 5'50" |

TABLE III

| TESTS | METHOD | SPECIFICATION REQUIREMENT | | QUAL NO M-5056 | RESULTS |
|---|---|---|---|---|---|
| Gravity, ° API at 60° F | D 287 | 29.0 – | 32.0 | 30.5 | 30.6 |
| Specific at 60/60° F | Table 3 | 0.865 – | 0.882 | 0.873 | 0.873 |
| Pounds per gallon at 60° F | Table 8 | 7.206 – | 7.341 | 7.273 | 7.269 |
| Viscosity at 100° F, cs | D 445 | 14.0 | Min | 14.3 | 14.09 |
| Viscosity at −40° F, cs | | 800 | Max | 665 | 634 |
| Viscosity at −65° F, cs | | 3500 | Max | 3478 | 3210 |
| Pour Point, ° F | D 97 | −75 | Max | −90 | <−80 |
| Flash Point, COC, ° F | D 92 | 200 | Min | 215 | 235 |
| Acid or Base No. | D 974 | 0.20 | Max | 0.070 | 0.084 |
| Trace Sedirent, ml | D 2273 | 0.005 | Max | 0.000 | 0.000 |
| Water by KFR, % | D 1744 | 0.05 | Max | 0.009 | 0.025 |
| Color, as per Standard | Spec | Pass | | Pass | Pass |
| Corr-Oxid Stab, 168 hrs at 250° | 5308 | | | | |
| Corrosion, pitting or etching | | None | | None | None |
| Cu, weight change, mg/cm² | | 0.6 | Max | 0.6 | 0.072 |
| St, weight change, mg/cm² | | 0.2 | Max | 0.0 | 0.040 |
| Al, weight change, mg/cm² | | 0.2 | Max | 0.2 | 0.008 |
| Mg, weight change, mg/cm² | | 0.2 | Max | 0.0 | 0.040 |
| Cd, weight change, mg/cm² | | 0.2 | Max | 0.2 | 0.032 |
| Oxidation, separation or gumming | | None | | None | None |
| Change in Vis at 100° F | | −5 to | 20 | 4.1 | 7.9 |
| Increase in Acid No. | | 0.2 | Max | 0.0 | 0.023 |
| Cu Strip, 72 hrs at 212° F, ASTM No. | D 130 | Less than | 3 | 1b | 1b |
| Corr. Inhibition, Polished Panels | D 1748 | Pass | | Pass | Pass |
| Sandblasted Panels | 5329 | Pass | | Pass | Pass |
| Low Temp Stab. 72 hrs at −65° F | 3458 | Pass | | Pass | Pass |
| Rubber Swell, 168 hrs at 158° F, % | 3603 | 19.0 – | 28.0 | 22.25 | 23.49 |
| Evaporation Loss, 22 hrs at 210° F, % | D 971 | 70 | Max | 49.5 | 52.9 |
| Corrosivity, 10 days | 5322 | Pass | | Pass | Pass |
| Steel-on-steel wear, AWSD, mm | 6514 | 1 | Max | 0.65 | 0.88 |
| Foam, Tendency/Stability, ml | D 892 | | | | |
| Seq. 1, 75° F, ml 70" Break | | 65/0 | Max | 50/0 | 60/0 |
| Seq. 2, 200° F, ml 30" Break | | 65/0 | Max | 30/0 | 40/0 |
| Seq. 3, 75° F, ml 51" Break | | 65/0 | Max | 50/0 | 75/0 |
| Particulate Contamination per 100 ml | 3009 | | | | |
| Particle size, 5 – 15, microns | | 2500 | Max | 510 | 240 |
| Particle size, 16 – 25, microns | | 1000 | Max | 170 | 100 |
| Particle size, 26 – 50, microns | | 250 | Max | 59 | 17 |
| Particle size, 51 – 100, microns | | 25 | Max | 9 | 4 |
| Particle size, Over 100, microns | | 5 | Max | 2 | 1 |
| Filtration Time, minutes | | 15 | Max | 5'24" | 5' |
| Sulfated Residue, % | D 874 | — | Max | 0.20 | 0.23. |
| QAS Barium, % | | — | | 0.13 | 0.12 |
| VIS at 210° F (cs) | | | | | 4.76 |

While the principle of this invention has been described with particularity, it should be understood that various alterations and modifications can be made without departing from the spirit of the invention, the scope of which is defined by the appended claims.

What is claimed is:

1. A method for reclaiming used and contaminated petroleum base aircraft-operational, hydraulic fluids which consist of the following sequential steps:

a. maintaining said contaminated fluid in a settling reservoir for a period of time sufficient to remove heavy particulate matter.

b. aerating said settled fluid by passing chemically dried air through the fluid;

c. adding an antifoaming agent together with only supplemental amounts of antioxidant, antiwear and corrosion inhibiting agents to said aerated fluid, said amounts being sufficient to reconstitute the fluid such that it possesses substantially the same characteristics as the unused fluid;

d. filtering fine particulate matter from the aerated fluids; and e. drawing off the reclaimed hydraulic fluid for distribution to suitable storage containers.

* * * * *